US006987939B2

(12) United States Patent
Ishiyama et al.

(10) Patent No.: US 6,987,939 B2
(45) Date of Patent: Jan. 17, 2006

(54) IMAGE FORMING APPARATUS WITH TWO CLEANING ELECTRIC FIELDS FOR TRANSFERRING DEVELOPER FROM A DEVELOPER CHARGING DEVICE ONTO AN IMAGE BEARING MEMBER

(75) Inventors: Tatsunori Ishiyama, Numazu (JP); Yasuo Yoda, Numazu (JP); Kenichi Iida, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/676,106

(22) Filed: Oct. 2, 2003

(65) Prior Publication Data

US 2005/0078981 A1 Apr. 14, 2005

(30) Foreign Application Priority Data

Oct. 2, 2002 (JP) ..... 2002-289849

(51) Int. Cl.
*G03G 21/00* (2006.01)

(52) U.S. Cl. ..... 399/129

(58) Field of Classification Search ..... 399/175, 399/174, 129, 149, 150, 353, 354
See application file for complete search history.

(56) References Cited

U.S. PATENT DOCUMENTS 5,144,368 A 9/1992 Ohzeki et al. ..... 355/219
5,970,285 A * 10/1999 Ito et al. ..... 399/149
6,442,362 B2 * 8/2002 Hirabayashi et al. ..... 399/149
6,744,994 B2 * 6/2004 Yoshikawa et al. ..... 399/150
2002/0085859 A1 * 7/2002 Hashimoto et al. ..... 399/174
2003/0049048 A1 3/2003 Yoshikawa et al. ..... 399/129
2003/0049049 A1 * 3/2003 Hoshi et al. ..... 399/129

FOREIGN PATENT DOCUMENTS

JP 5-61383 3/1993

* cited by examiner

*Primary Examiner*—Susan Lee
(74) *Attorney, Agent, or Firm*—Fitzpatrick, Cella, Harper & Scinto

(57) ABSTRACT

An image forming apparatus includes an image bearing member; a charging device for electrically charging the image bearing member at a contact position; a transferring device for transferring a developed image on the image bearing member onto a transfer material; and a developer charging device for electrically charging a developer remaining on the image bearing member after the image is transferred. The developer charging device is disposed downstream of the transferring device and upstream of the charging device with respect to a moving direction of the image bearing member. An electric field forming device forms a cleaning electric field in a direction of transferring the developer from the developer charging device onto a predetermined region of the image bearing member and forms a cleaning electric field for transferring the developer from the charging device onto the image bearing member after the predetermined region passes through the contact portion.

24 Claims, 9 Drawing Sheets

IMAGE FORMING APPARATUS WITH TWO CLEANING ELECTRIC FIELDS FOR TRANSFERRING DEVELOPER FROM A DEVELOPER CHARGING DEVICE ONTO AN IMAGE BEARING MEMBER

FIELD OF THE INVENTION AND RELATED ART

The present invention relate to an image forming apparatus, for example, a copying machine, a printer, a facsimileing machine, etc., which forms an image with the use of an electrophotographic method, an electrostatic recording method, or the like.

As for this type of an image forming apparatus, that is, a copying machine, a printer, etc., which employs one of the electrophotographic image forming methods, those structured as shown in FIG. 8 have been available.

In the case of this image forming apparatus, a photoconductive drum 101 is rotationally driven in the direction indicated by an arrow mark a (clockwise direction). As the photoconductive drum 101 is rotated, the following processes are sequentially carried out.

First, the peripheral surface of the photoconductive drum 101 is uniformly charged by a charge roller 2 to which bias is being applied. Then, the charged portion of the surface of the photoconductive drum 101 is exposed to a beam of light projected, while being modulated with image formation signals inputted into the exposing apparatus 103, from an exposing apparatus 103. As a result, an electrostatic latent image is formed on the peripheral surface of the photoconductive drum 101.

The electrostatic latent image is developed into a toner image by the development sleeve 104*a* of a developing apparatus 104, the peripheral surface of which is coated with a thin layer of toner.

After being formed on the peripheral surface of the photoconductive drum 101, the toner image is conveyed to a transfer station Nt' by the rotation of the photoconductive drum 101. The transfer station Nt' is created by the photoconductive drum 101 and a transfer roller 105. In synchronism with the arrival of the toner image on the photoconductive drum 101, at the transfer station Nt', a transfer medium P such as a sheet of recording paper is delivered to the transfer station Nt' by an unshown sheet conveying apparatus, and while the toner image and transfer medium P are passing through the transfer station Nt', transfer bias, which is opposite in polarity to the toner, is applied to the transfer roller 105 from a high voltage transfer power source 106 to give to the back side of the transfer medium P, such electrical charge that is opposite in polarity to the toner. As a result, the toner image on the photoconductive drum 101 is transferred onto the surface of the transfer medium P.

After the transfer of the toner image onto the transfer medium P, the transfer medium P is electrostatically separated from the photoconductive drum 101 by a separation charging device 107, and is conveyed to a fixing apparatus (unshown). In the fixing apparatus, the toner image is thermally fixed to the surface of the transfer medium P. Thereafter, the transfer medium P is discharged out of the image forming apparatus.

Meanwhile, the transfer residual toner, that is, the toner remaining on the photoconductive drum 101 after the above described transfer, is removed by a cleaning apparatus 108 and is recovered. Then, the photoconductive drum 101 is used for the following image formation cycle. In other words, the photoconductive drum 101 is repeatedly used for image formation.

In recent years, it has been desired to reduce an image forming apparatus such as the one described above in overall size, and in order to reduce the overall size of an image formation apparatus, each of the means for carrying out the image formation processes such as charging, exposing, developing, transferring, fixing, and cleaning processes, etc., has been gradually reduced in size. However, simply reducing in size a photoconductive drum, each of the processing means, and each of the various devices, which make up an image forming apparatus, has its limit in reducing an image forming apparatus in overall size.

Thus, the so-called cleaner-less system (cleaning-while-developing system), which does not require a physical cleaning mechanism, has been put to practical use as one of the newest methods for reducing an image forming apparatus an size (Japanese Laid-open Patent Application 05-61383).

This cleaner-less cleaning system is a system which does not employ the blade, fur brush, roller, or the like, employed by an ordinary cleaning apparatus for removing the transfer residual toner remaining an a photoconductive drum after a transfer process, and a waste toner container for storing the recovered transfer residual toner. Therefore, the employment of this system makes it possible to reduce an image forming apparatus in the overall size.

The general structure of the so-called cleaner-less system is shown in FIG. 9.

The basic structure of a cleaner-less image forming apparatus is the same as that of the structure of the aforementioned image forming apparatus shown in FIG. 8. In other words, the only difference between the two apparatuses is that the apparatus shown in FIG. 9 does not have the cleaning apparatus (cleaning blade) shown in FIG. 8.

The simple removal of the cleaning apparatus allows the residual toner remaining on the photoconductive drum after the transfer to directly adhere to the charge roller 102, making it impossible for the peripheral surface of the photoconductive drum to be uniformly charged; in other words, it causes the photoconductive drum to be improperly charged.

In recent years, it has been discovered that the placement of an auxiliary charging member 109 on the upstream side of the charge roller 102 with reference to the rotational direction of the photoconductive drum in FIG. 9 is effective to solve this problem. Usually, a charging member shaped like a brush capable of temporarily holding the transfer residual toner remaining after transfer, and holding the fog causing toner, is employed as the auxiliary charging member 109 (which hereinafter may be referred to as toner charging brush).

To the toner charging brush 109, DC bias similar in polarity to toner is applied from an unshown high voltage power source.

A cleaner-less system which employs the above described toner charging brush is structured as will be described next.

As the photoconductive drum is rotationally driven, the transfer residual toner, which in unstable in polarity, reaches the toner charging brush 109. As the transfer residual toner reaches the toner charging brush 109, not only if it physically captured by the toner charging brush 109, but also it is negatively charged by the DC bias, which is being applied to the toner charging brush 109, to a potential level (−40 − −80 $\mu$C/g) higher than the potential level (approximately −15 − −40 $\mu$C/g) to which it is charged during development;

hereinafter, this negatively charged toner with a higher potential will be referred to as hyped negative toner.

As the photoconductive drum is rotated, the hyped negative toner, that is, the toner which has just been negatively charged to the higher potential, is gradually released from the brush, and reaches the charging station.

The electrostatic force by which the hyped negative toner is kept adhered to the photoconductive drum is greater than the force of the electrical field which acts on the hyped negative toner in the charging station. Therefore, the hyped negative toner passes through the charging station, without being adhered to the charge roller 102. However, while the hyped negative toner is passing through the charging station, the amount of the negative charge of the hyped negative toner is slightly reduced by the AC bias present in the charging station. As a result, the hyped negative toner turns into such negative toner that is close in the amount of electrical charge to the normal negatively charged toner.

Thereafter, the residual toner, which at this point in the process has the normal amount of negative charge, is conveyed to the developing device. As it reaches the developing device, it is temporarily taken into the developing device, by the development AC bias and the rotation of the development sleeve, and then, is used again for image formation.

In the case a cleaner-less system such as the one described above, transfer residual toner remaining on a photoconductive drum is recovered into the developing device to be used again as developer, instead of being discarded as waste toner. In other words, a cleaner-less system is very effective system from the ecological standpoint.

Also in the case of a cleaner-less system, a cleaning member in the form of a blade, fur brush, roller, or the like is not placed in contact with the peripheral surface of a photoconductive drum, substantially reducing the wear of the photoconductive drum. In other words, this cleaning system is beneficial in that it can extend the service life of a photoconductive drum.

However, a cleaner-less system structured as described above suffers from the following problems.

That is, the transfer residual toner remaining on a photoconductive drum after transfer adheres to a toner charging brush and/or a charging member, degrading the toner charging brush and/or charging member. Consequently, a photoconductive drum fails to be charged to the normal potential level, resulting in the formation of an image, the entirety of which is covered with fog.

This problem is likely to occur, in particular, when outputting an image having areas with a higher printing ratio, for example, solid areas.

The reason for this problem is as follows.

The higher the printing ratio of an image (pattern) to be outputted, the greater the amount of the toner remaining on a photoconductive drum after transfer, and therefore, the greater the amount of the toner to be recovered by a toner charging brush. Further, the greater the amount of the toner to be recovered by a toner charging brush, the more difficult it is for the entirety of the recovered toner to make contact with the toner charging brush; and therefore, the more difficult it is for the recovered residual toner to be entirely turned into hyped negative toner.

The portion of the residual toner, which failed to be turned into hyped negative toner, slips out of a toner charging brush due to the physical force resulting from the rotation of a photoconductive drum.

The portion of the residual toner, which slipped out of the toner charging brush, is unstable in the amount of electrical charge, as well as polarity. Therefore, it is prone to adhere to a charge roller as it reaches the charge roller.

Toner is high in electrical resistance. Therefore, as it adheres to a charge roller, it interferes with the charging of a photoconductive drum, making it difficult for the photoconductive drum to be uniformly charged to predetermined polarity and potential level.

As it becomes difficult for the peripheral surface of a photoconductive drum to be uniformly charged, the points of the peripheral surface of the photoconductive drum, which failed to be sufficiently, are developed darker than the surrounding portions. If this phenomenon occurs when forming a halftone image, an image irregular in density will be formed; in the worst case, an image covered with fog across its entirety will be formed.

The above described fog occurs everywhere across an image whether a given area of the image is an "image area" or a "background area". Therefore, the amount of the toner which reaches a toner charging brush further increases, making it more difficult for a toner charging brush to turn the residual toner into hyped negative toner. Therefore, more toner adheres to a charge roller, which results in the formation of a very foggy image, that is, an image with defects traceable to improper charging of a photoconductive drum.

Thus, a cleaning sequence for expelling from a charge roller and/or a toner charging roller, the toner having adhered to the charge roller and/or toner charging brush, has been proposed (Japanese Laid-open Patent Application 2003-49048). However, this proposal also has a problem. That is, as this cleaning sequence is carried out, the toner having expelled from a toner charging brush adheres to a charge roller.

SUMMARY OF THE INVENTION

The present invention is made to solve the problems of the above described prior arts, and its primary object is to provide an image forming apparatus capable of always outputting excellent images.

Another object of the present invention is to prevent the phenomenon that developer adheres to a primary charging means while a developer charging means is cleaned.

Another object of the present invention is to better clean the roller of the primary charging means, across the entirety of its peripheral surface, provided that the charging member of the charging means is in the form of a roller.

Another object of the present invention is to prevent the occurrence of carrier adhesion in the developing means, during the cleaning of the developer charging means and primary charging means, by making the surface potential of the image bearing member uniform (at zero) across the entirety of the peripheral surface of the image bearing member.

Another object of the present invention is to improve the cleaning efficiency of an image forming apparatus having multiple image forming means, and also to reduce the length of the cleaning time thereof.

Another object of the present invention is to provide an image forming apparatus capable of always outputting superb images for a long period of time, by regularly cleaning its auxiliary charging means and primary charging means, based on the cumulative number of the outputted prints, the cumulative length of exposure time, or the like.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. The measurements, materials, and shapes of structural components, and their positional relationship, in the following embodiments of the present invention, are not intended to limit the scope of the present invention, unless specifically noted.

Embodiment 1

First, referring to FIGS. 1–3, the image forming apparatus in the first embodiment of the present invention will be described.

Figure 1:
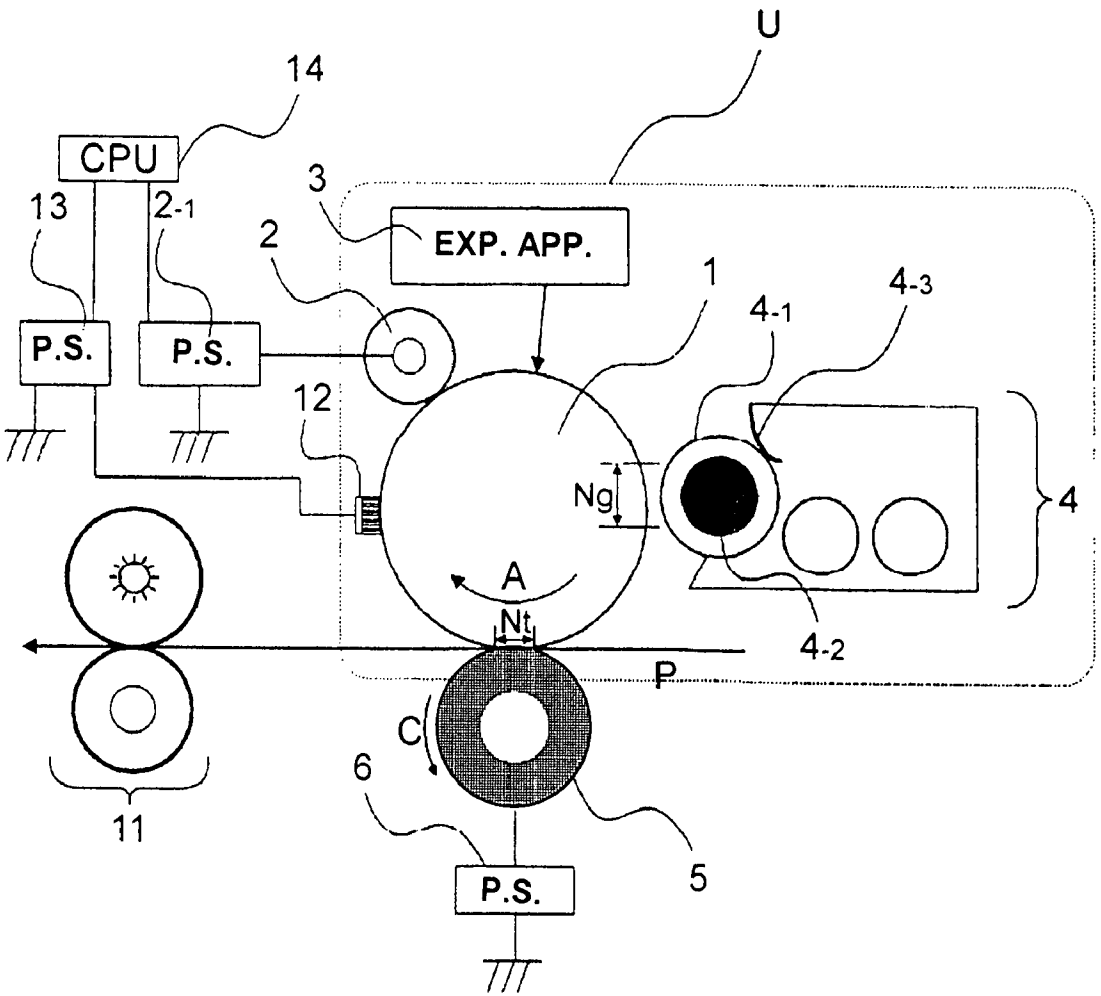
FIG. 1 is a sectional view of the image forming apparatus in the first embodiment of the present invention, for showing the general structure thereof.

Referring to FIG. 1, a cylindrical photoconductive drum 1 as an image bearing member is being rotationally driven in the direction indicated by an arrow mark A at a peripheral velocity of 100 mm/sec. A charge roller 2 as a charging means is of a contact type, that is, a charge roller which is placed in contact with the photoconductive drum 1 to charge the photoconductive drum 1. It comprises an electrically conductive metallic core, an electrically conductive rubber layer coated on the peripheral surface of the metallic core, and a resistive layer coated on the peripheral surface of the rubber layer. It is rotated by the rotation of the photoconductive drum 1. To the metallic core of the charge roller 2, the combination of a DC voltage of −700 V and an AC bias with a peak-to-peak voltage of 1 KVp-p is applied from a charge bias power source 2-1 in response to the signals from a CPU 14 as a part of an electrical field forming means. As a result, the peripheral surface of the photoconductive drum 1 is uniformly charged to −700 V.

A drum exposing portion 3 as an exposing means exposes the charged portion of the peripheral surface of the photoconductive drum 1 to a beam of light emitted, while being modulated with the image forming information for an image to be formed, from a laser, an LED, or the like, of the exposing portion 3, As a result, an electrostatic latent image is formed on the peripheral surface of the photoconductive drum 1.

Designated by a referential number 4 is a contact type developing device, as a developing means, which employs two-component developer. It comprises: a development sleeve 4-1 for bearing the two-component developer, that is, a mixture of carrier and toner, and conveying it to the area in which the developer on the development sleeve 4-1 touches the peripheral surface of the photoconductive drum 1; a development magnet 4-2 disposed in the hollow of the development sleeve 4-1, and a developer regulating blade 4-3 for regulating the amount by which the developer is allowed to remain coated on the peripheral surface of the development sleeve 4-1.

The development sleeve 4-1 is rotationally driven in the direction opposite to the rotational direction of the photoconductive drum 1. As it is rotationally driven, its peripheral surface is coated with the developer, and then, the developer on the peripheral surface of the development sleeve 4-1 is made uniform in thickness by the developer regulating blade 4-3. Then, the uniform layer of the developer on the peripheral surface of the development sleeve 4-1 is conveyed to a development nip Ng, in which the development layer is capable of touching the peripheral surface of the photoconductive drum 1. To the development sleeve 4-1, the combination of a DC voltage of −300 V, and an AC bias which is −1 KVp-p in peak-to-peak voltage and 2 kHz in frequency, is applied. As a result, the toner particles in the developer layer transfer onto the photoconductive drum 1, developing the electrostatic latent image on the photoconductive drum 1 into a visible image, that is, an image formed of toner (which hereinafter will be referred to as toner image).

The toner image, that is, the visible image, having just been formed an the photoconductive drum 1 by the developing device 4 is conveyed by the rotation of the photoconductive drum 1 to a transfer station Nt, which is the interface between the peripheral surface of the photoconductive drum 1 and the peripheral surface of the transferring apparatus 5, as a transferring means, in the form of a roller, which is in contact with the photoconductive drum 1 and is being rotationally driven in the direction indicated by an arrow mark C. Meanwhile a sheet P of recording paper or the like, as a means onto which an image is transferred, is conveyed by an unshown sheet conveying mechanism to the transfer station Nt with such a timing that the sheet P will arrive at the transfer station Nt in synchronism with the arrival of the toner image on the photoconductive drum 1 at the transfer station Nt. Further, in synchronism with the arrival of the toner image and sheet P at the transfer station Nt, voltage opposite in polarity to that of the toner begins to be applied to the transferring apparatus 5 from a high voltage power source 6. As a result, the toner image on the photoconductive drum 1 is transferred onto the surface of the sheet P.

The transferring apparatus 5 in this embodiment is an elastic roller comprising a metallic core, and a single layer of elastic substance, for example, foamed semiconductive rubber, wrapped around the peripheral surface of the metallic core. Its volume resistivity value is in the range of $10^7$–$10^{13}$ Ω.

After the transfer of the toner image from the photoconductive drum 1 onto the sheet P, the sheet P separates from the photoconductive drum 1 due to the curvature of the photoconductive drum 1, and is conveyed to a fixing device 11 while bearing the toner image.

In the fixing device 11, the toner image on the surface of the sheet P is welded (fixed) to the surface of the sheet P by the application of heat and pressure. Then, the sheet P is discharged from the image forming apparatus.

Meanwhile, the portion of the peripheral surface of the photoconductive drum 1, from which the toner image has just been transferred onto the sheet P, reaches a toner charging brush 12 as a developer charging means, while bearing the toner particles which failed t transfer onto the sheet P. The toner charging brush 12 in this embodiment is a brush made of electrically conductive fibers, the electrical resistivity of which is no more than $10^5$ Ω. To this toner charging brush 12, a DC bias of −800 V is being applied from a high voltage power source 13 in response to the signals from the CPU 14.

As the transfer residual toner, which is a mixture of the negatively charged toner particles and positively charged toner particles, reaches the toner charging brush 12, most of the positively charged portion of the residual toner is recovered into the toner charging brush 12 by the electrical field formed by the toner charging brush 12 and photoconductive drum 1. Then, a part of the transfer residual toner having just been recovered into the toner charging brush 12 is turned by the bias of −800 V being applied to the toner charging brush 12, into the aforementioned hyped negative toner, that is, such toner that is holding a greater amount of electrical charge than the normal amount of electrical charge given to toner for development.

The thus created hyped negative toner particles, and the toner particles which have been negative in polarity, slip by the toner charging brush 12, and reach the charge roller 2.

Due to the effect of the DC voltage bing applied to the charge roller 2, the hyped negative toner particles, and the like, do not adhere to the charge roller 2, in the charging station.

However, they are deprived, by a small amount, of electrical charge, by the AC bias being applied to the charge roller 2, along with the DC voltage.

After slipping through the charging station, they are recovered onto the development sleeve 4-1, in the development station Ng, and are used again after being adjusted in electrical characteristics, in the developing device 4.

However, when an image having areas with a higher printing ratio is outputted, or in the like situation, in other words, when a large amount of toner is recovered into the toner charging brush 12, it is unlikely that all the particles in the recovered toner will come into contact with the toner charging brush 12; in other words, it is difficult to turn all the residual toner particles into hyped negative toner particles, that is, negatively charged toner particles with higher potential. Therefore, some residual toner particles fail to be turned into hyped negative toner particles, and therefore, slip through the toner charging brush 12, and adhere to the charge roller 2. Consequently, the photoconductive drum 1 is improperly charged.

Thus, in this embodiment, an arrangement is made so that before the amount of the toner having recovered into the toner charging brush reaches a specific value above which the photoconductive drum is improperly charged, the toner adhering to the toner charging brush and charge roller is removed.

Next, the electrical field for removing the toner on the toner charging brush, and the electrical field for removing the toner on the charge roller, will be described with reference to the high voltage sequence chart given in FIG. 2(*a*). The process for cleaning the toner charging brush and the process for cleaning the charge roller are carried out in response to the signals from the CPU as a part of the electrical field generating means.

First, referring to FIG. 2(*a*), a comparative method, that is, a method in accordance with prior arts, for cleaning the toner charging brush will be described with reference to a process B-1 of the timing chart for the comparative method.

In this case, after the bias which was being charged to the toner charging brush is temporarily turned off, a DC bias of −300 V is applied in a pulsating manner, in order to generate the electrical field for cleaning the toner charging brush; more specifically, it is turned on and off five times with intervals of 50 ms. As the bias applied to the toner charging brush is turned on and off, the toner having accumulated in the brush adheres to the peripheral surface of the photoconductive drum due to the shocks which occur as the bias is turned on.

The value of the bias to be applied to the toner charging brush, and the timing and intervals with which the bias is to be applied, are matched with the cleaning performance of the brush, and the responsiveness of the high voltage power source.

Next, the method for generating the electrical field for cleaning the charge roller will be described.

The charge roller needs to be cleaned across the entirety of its peripheral surface. Therefore, turning on and off, in a pulsating manner, the DC bias being applied to the charge roller as is the DC bias applied to the toner charging brush is not sufficient to thoroughly clean the charge roller. In addition, the charge roller is required to remove abnormal electrical charge from the photoconductive drum to uniformly charge the photoconductive drum (in order to prevent carrier from adhering to photoconductive drum, or to prevent fog formation). Therefore, it is necessary to apply AC bias, in addition to the DC bias, to the charge roller.

For these reasons, various attempts were made to find a method which makes it possible to clean a charge roller while applying AC bias to the charge roller in addition to DC bias. As a result, it was found that even when AC bias is applied to a charge roller, the charge roller can be satisfactorily cleaned by making the value of the AC bias (Vpp) applied to the charge roller during the cleaning of the charge roller different from the value of the AC bias applied during the period in which an image is actually formed.

Figure 2:
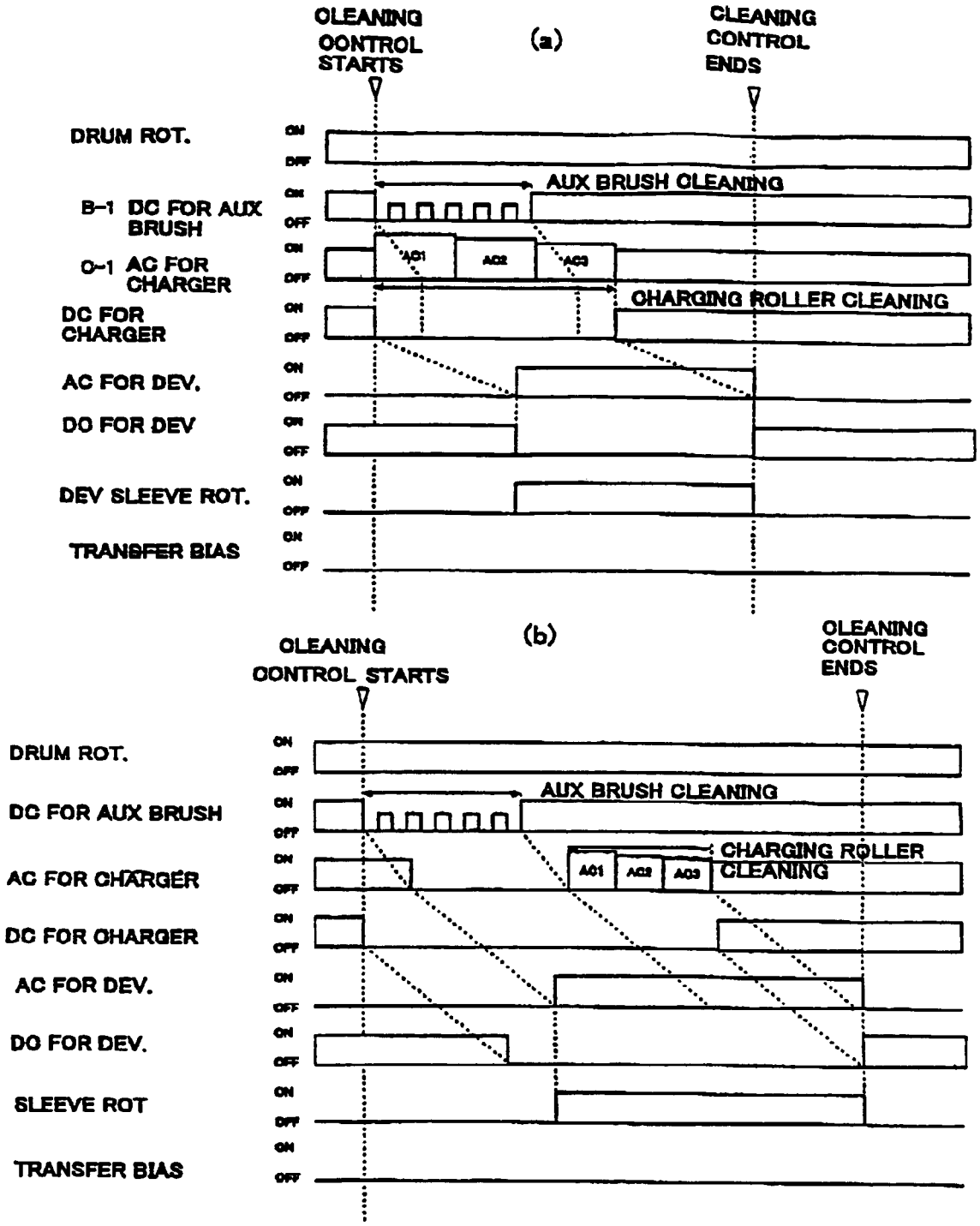
FIGS. 2(*a*) and 2(*b*) are timing charts of the cleaning sequence in the first embodiment of the present invention.

In the case of the high voltage sequence C-1 shown in FIG. 2(*a*), three different AC biases are applied: AC1=1.4 KVp-p; AC2=1.3 KVp-p; and AC3= 1.2 KVp-p. The duration of each bias is made equal to the length of the time required for a single full rotation of the roller. By rotating the roller no less than one full turn, the roller is cleaned across the entirety of its peripheral surface, and by switching the peak-to-peak voltage after rotating the roller no less than one full turn, the roller is better cleaned. As for the DC voltage, by setting it to zero (DC=0 V), the potential level of the photoconductive drum at its peripheral surface is made to converge to 0 V; the electrical charge of the photoconductive drum is made uniform at 0 V across the entirety of the portion of its peripheral surface which comes into contact with the charge roller.

When the sequence shown in FIG. 2(*a*) was actually carried out, the toner particles expelled from the toner charging brush adhered to the charge roller.

The studies made to find the causes for the above problem revealed the following. That is, the process (B-1) for cleaning the toner charging brush, and the process (C-1) for cleaning the charge roller, were started at the same time. Thus, the portion of the peripheral surface of the photoconductive drum, with which the toner charging brush came into contact while it was cleaned, overlapped with the portion of the peripheral surface of the photoconductive drum, with which the charge roller came into contact while it was cleaned. As a result, the toner particles having just been expelled from the toner charging brush reached the charge roller due to the movement of the peripheral surface of the photoconductive drum, and were made to adhere to the charge roller by the bias being applied to the charge roller.

Therefore, studies were made to find out how the toner adhesion to the charge roller was affected by the type of the bias actually applied to the charge roller. The results are given in Table 1 given below.

TABLE 1

| | BIAS TO CHARGING ROLLER | | | |
|---|---|---|---|---|
| | AC BIAS | DC BIAS | AC + DC BIAS | NON-BIAS (GRND) |
| TONER DESCRIPTION ON ROLLER | N | N | N | F |

N: Toner deposition is apparent on image
F: Toner deposition is light on image (half-tone images)

In this case, the polarity of the DC voltage applied to the charge roller was negative, being same as the polarity to which the photoconductive drum was charged, because, if voltage opposite in polarity to the polarity to which the photoconductive drum is charged for image formation, is applied to the charge roller, electrical memories are created in the photoconductive drum, which result in the formation of a defective image.

The results given in Table 1 revealed the following two facts.

(1) It is when bias was not applied that toner adhered to the charge roller by the least amount; and (2) A small amount of toner will adhere to the charge roller even if no bias is applied.

Therefore, the following were concluded as means to attain our objectives:

(1)' An arrangement should be made so that the portion of the peripheral surface of a photoconductive drum, with which a toner charging brush comes into contact while being cleaned, does not overlap with the portion of the peripheral surface of the photoconductive drum, with which a charge roller comes into contact while being cleaned; and (2)' An arrangement should be made so that a charge roller is cleaned after the toner particles having just been expelled onto the peripheral surface of a photoconductive drum from a toner charging brush during the cleaning of the toner charging brush, passes the charge roller (if the charge roller is cleaned before the toner particles having just been expelled onto the peripheral surface of a photoconductive drum from a toner charging brush pass by a charge roller, a small amount of toner particles will adhere to the charge roller).

Based on the above discoveries, the cleaning process shown in FIG. 2(*b*), as one of the embodiments of the present invention, was invented. More specifically, while the portion of the peripheral surface of a photoconductive drum, onto which toner particles have just been expelled from a toner charging brush by an electrical field generated for cleaning a toner charging brush, is in contact with a charge roller, the DC and AC voltages which have been applied to the charge roller are kept reduced to 0 V, in order to prevent the toner particles from adhering to the charge roller. Further, the charge roller is cleaned after the portion of the peripheral surface of the photoconductive drum, onto which toner particles have just been expelled, passes through the nip between the charge roller and photoconductive drum. Therefore, even if the toner having just been expelled from the toner charging brush adheres to the charge roller by a small amount, this small amount of toner adhering to the charge roller is removed during the cleaning of the charge roller. In other words, the toner adhesion to the charge roller is completely prevented. When this cleaning process shown in FIG. 2(*b*) was actually carried out by an image forming apparatus, the toner adhering to the toner charging brush and the toner adhering to the charge roller were removed virtually in entirety. Incidentally, the biases applied for the cleaning are the same as those applied in the comparative example.

As for the timing for carrying out the cleaning sequence shown in FIG. 2(*b*), the sequence is carried out during a non-image formation period, that is, while no image is actually formed. Incidentally, an image formation period means a period in which a toner image to be transferred onto a sheet of transfer medium is being actually formed on a photoconductive drum. Thus, a non-image formation period includes the periods other than an image formation period. In other words, a non-image formation period includes: the pre-rotation period of the photoconductive drum, that is, the period from when the main power source of an image forming apparatus is turned on, to when the image forming apparatus reaches the standby state; sheet interval between the completion of the image formation on a preceding sheet of recording medium and the starting of the image formation on a following sheet of recording medium; and post-rotation of the photoconductive drum, that is, the period from when one printing job is completed to when the image forming apparatus regains the standby condition.

Incidentally, it takes no less than three seconds to carry out this sequence. Thus, it is a concern that the frequency at which the sequence is carried out affects the throughput (ppm) of an image forming apparatus.

Therefore, it is desired that the cleaning sequence in this embodiment of the present invention is carried out with such a timing that does not affect the throughput (ppm) of an image forming apparatus; in other words, it is carried out during the pre-rotation, or post-rotation period.

However, carrying out the above described cleaning sequence only during the pro- or post-rotation period resulted in the following problem. That is, as long as the number (calculated in terms of A4 size) of sheets of recording medium on which a given printing Job forms an image is no more than several tens, no defective image (foggy image), the defects of which are traceable to the improper charging of a photoconductive drum, was printed. But, in the case of a printing operation in which several hundreds of prints were continuously made, detective images (foggy images) were sometimes outputted during the latter half of the operation, because the continuous printing operation offered no time for carrying out the above described cleaning sequence.

Table 2 given below shows the extent of the toner recovery made by a toner charging brush during printing operations different in the number by which a solid image, that is, an image with the highest printing ratio, was repeatedly and continuously printed.

TABLE 2

| NO. OF PRINTS | AUX. BRUSH CONTAMINATION PREVENTION | ROLLER CONTAMINATION PREVENTION |
|---|---|---|
| 10 | G | G |
| 20 | G | G |
| 50 | F | G |
| 70 | F | G |
| 100 | F | F |
| 120 | N | F |
| 150 | N | N |
| 170 | N | N |
| 200 | N | N |

(BASED ON A4 SHEETS)

Looking at Table 2, a toner charging brush began to become gradually soiled approximately at the time when the number of the outputted prints reached 50, and the extent of the contamination of the toner charging brush by toner was at the NG level (N: level at which amount of toner which slips by toner charging brush is substantial) after the number of the outputted prints exceeded 100.

Compared to the timing of the contamination of a charge roller, the contamination of a toner charging brush occurred slightly later, that is, several sheets later, in terms of sheet counts. More specifically, the charge roller began to be soiled approximately at 100 sheets (F: level at which contamination is vaguely visible across halftone portions of image), and the extent of the contamination of the toner charging brush by toner was at a serious level (N: level at which contamination is apparent even across solid portion of image) after the number of the outputted prints exceeded 150.

It became evident from the results given in this table that when a given printing job is such that no less then 100 copies are continuously outputted, the above described cleaning sequence should be carried out during the printing job.

Next, the process for determining whether or not the cleaning sequence is to be carried out will be described following the control flow chart given in FIG. 3.

Figure 3:
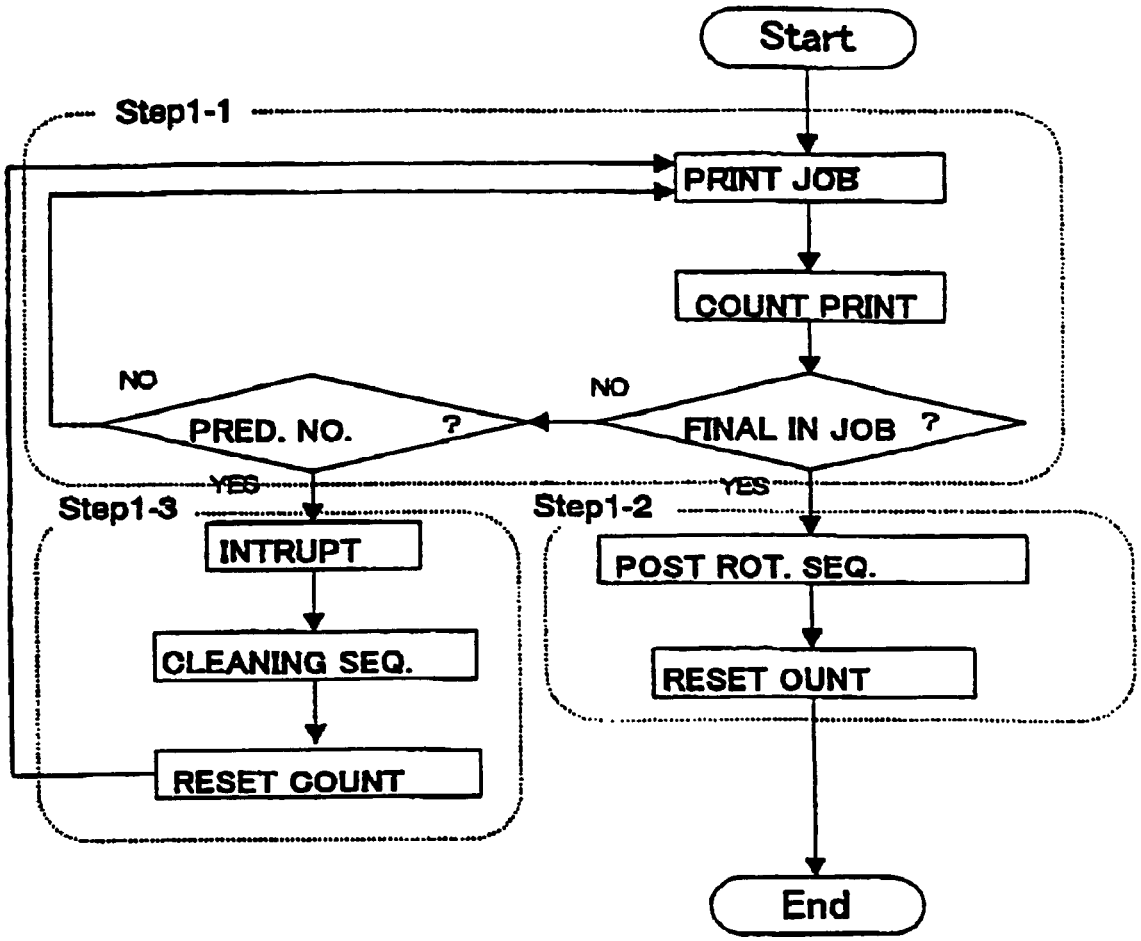
FIG. 3 is a flowchart of the cleaning sequence in the first embodiment of the present invention, for showing the control timing for the sequence.

Referring to FIG. 3, as a printing job is started, the CPU 14 begins to count the number (counted in terms of A4 size) of outputted prints, and whether the print output count has reached the preset value (100 in this embodiment), at which the cleaning sequence is to be carried out, is constantly checked (Step 1-1).

If a given job ends before the print count reaches 100 (when cleaning sequence is carried out during post-rotation period), the print count is set to zero (Step 1-2).

If the print count reaches 100 before a given job is completed, the job is interrupted, and the sequence for cleaning a toner charging brush and a charge roller is carried out. Then, the print count is set to zero after the completion of the cleaning sequence, and the job is restarted from the point of interruption (Step 1-3).

In other words, according to this embodiment of the present invention, in the case of a printing job in which prints are continuously outputted, the outputted prints are counted while prints are continuously outputted. Then, the cleaning sequence is carried out as the print count reaches a preset value. Therefore, the printing of a defective image, the defects of which are traceable to the improper charging of a photoconductive drum, can be prevented without substantially affecting the throughput of an image forming apparatus.

As described above, in the case of a cleaner-less image forming apparatus in this embodiment of the present invention, its toner charging brush and charge roller are cleaned in the following manner:

(1) The toner charging brush and charge roller are cleaned in the listed order.

(2) Normally, that is, if a given job is relatively small in terms of print count, the cleaning sequence is carried out during the post-rotation period after the completion of the job. However, if a given job exceeds a predetermined value in terms of print count, the job is interrupted as the print count reaches the predetermined value, and both the toner charging brush and charge roller are cleaned.

With the employment of the above described method for cleaning a toner charging brush and a charge roller, the printing of a defective image, the defects of which are traceable to the improper charging of a photoconductive drum, can be prevented regardless of the type of a printing job. Therefore, an image forming apparatus is enabled to continuously output superb prints for a long period of time.

Also, with the employment of the above described cleaning method, it is possible to reduce the size of an image formation unit, without reducing the cleaning performance of a cleaner-less system.

In this embodiment, the cleaning was initiated based on the print count calculated in terms of A4 size. However, the conditions under which the cleaning sequence is initiated may be altered according to the size, material, etc., of a recording medium. For example, when sheets of A3 size (twice as large as A4 size) are used, the cleaning sequence may be initiated with half the interval, with which the cleaning sequence is initiated when sheets of A4 size are used.

Incidentally, in this embodiment, the method in which the toner outputted from the charge roller and toner charging brush are recovered by the developing device was employed. However, an image forming apparatus may be structured so that the toner is recovered by the transferring apparatus.

Embodiment 2

Next, the second embodiment of the present invention, which is a method for determining the timing with which a toner charging brush is cleaned, and the timing with which a charge roller in cleaned, in accordance with cumulative picture element count or cumulative exposure time, will be described.

The structure of the image forming apparatus in this embodiment is similar to that in the first embodiment. Therefore, its detailed description will not be given here.

Figure 4:
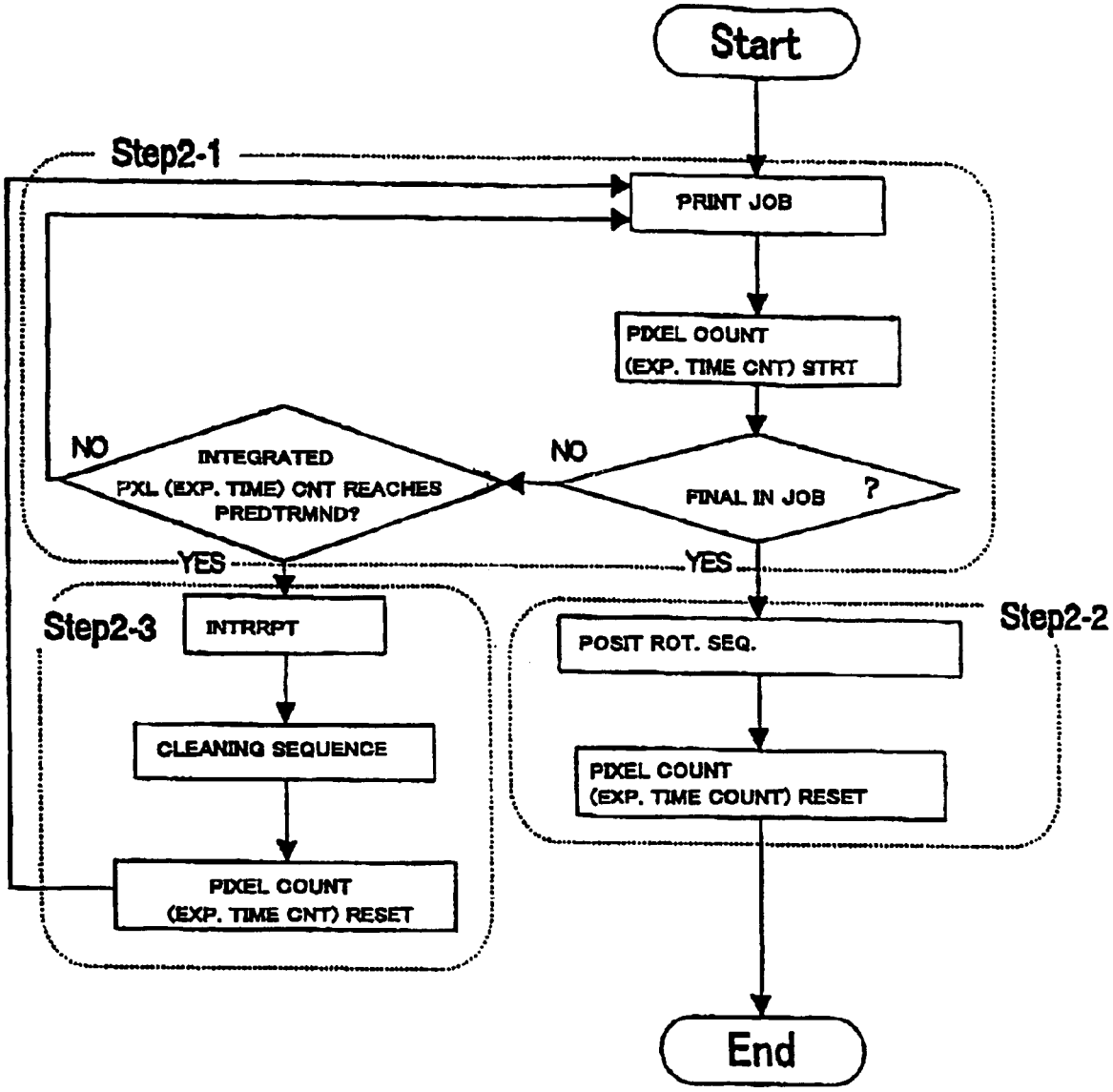
FIG. 4 is a flowchart of the cleaning sequence in the second embodiment of the present invention, for showing the control timing for the sequence.

First, referring to the flowchart given in FIG. 4, what kind of controls are executed with the use of the structural arrangement of this image forming apparatus will be described.

In the case of the flowchart given in FIG. 4, as a given printing job is started, the counting of the cumulative picture elements (which hereinafter will be referred to as pic-cell) or the cumulative exposure time, is started.

Then, it is continuously checked whether or not the value of the cumulative pic-cell count, or the value of the cumulative exposure time, has reached a value CP (value at which cleaning sequence is to be initiated) (Step 2-1).

If a given job ends before the value of the cumulative pic-cell count, or the value of the cumulative exposure time, reaches CP, the cumulated pic-cell count and the cumulated exposure time are set to zero, and the image forming apparatus is readied for the next job (Step 2-2).

However, if the value of the cumulative pic-cell count, or the value of the cumulative exposure time, reaches CP before a given job is completed, the job is interrupted, and the sequence for cleaning a toner charging brush and a charge roller is carried out. Then, the cumulated pic-cell count and the cumulated exposure time are set to zero after the completion of the cleaning sequence, and the job is restarted from the point of interruption (Step 2-3).

In other words, according to this embodiment of the present invention, in the case of a printing job in which prints are continuously outputted, the pic-cells or exposure time is cumulatively counted while prints are continuously outputted. Then, the cleaning sequence in carried out as the value of the cumulative pic-cell count, or the value of the cumulative exposure time, reaches a preset value (CP). Therefore, the effect of the cleaning sequence upon the throughput of an image forming apparatus is smaller than that in the first embodiment. Therefore, not only is it possible to reliably prevent the printing of a defective image, the defects of which are traceable to the improper charging of a photoconductive drum, but also it is possible to improve an image forming apparatus in terms of usability; for example, it is possible to reduce the down-time of an image forming apparatus.

Embodiment 3

The above described first and second embodiments were related to an image forming apparatus having only a single image formation unit. Instead, this embodiment is related to an image forming apparatus having multiple image formation units, as does a color image forming apparatus.

Except for the number of the image formation units, the structure and function of the image forming apparatus are the same as those in the first embodiment. Therefore, the structural components of the image forming apparatus in this embodiment, which are the same as those in the first embodiment, are given the same referential symbols as those given in the first embodiment, and they will be not described here.

Figure 5:
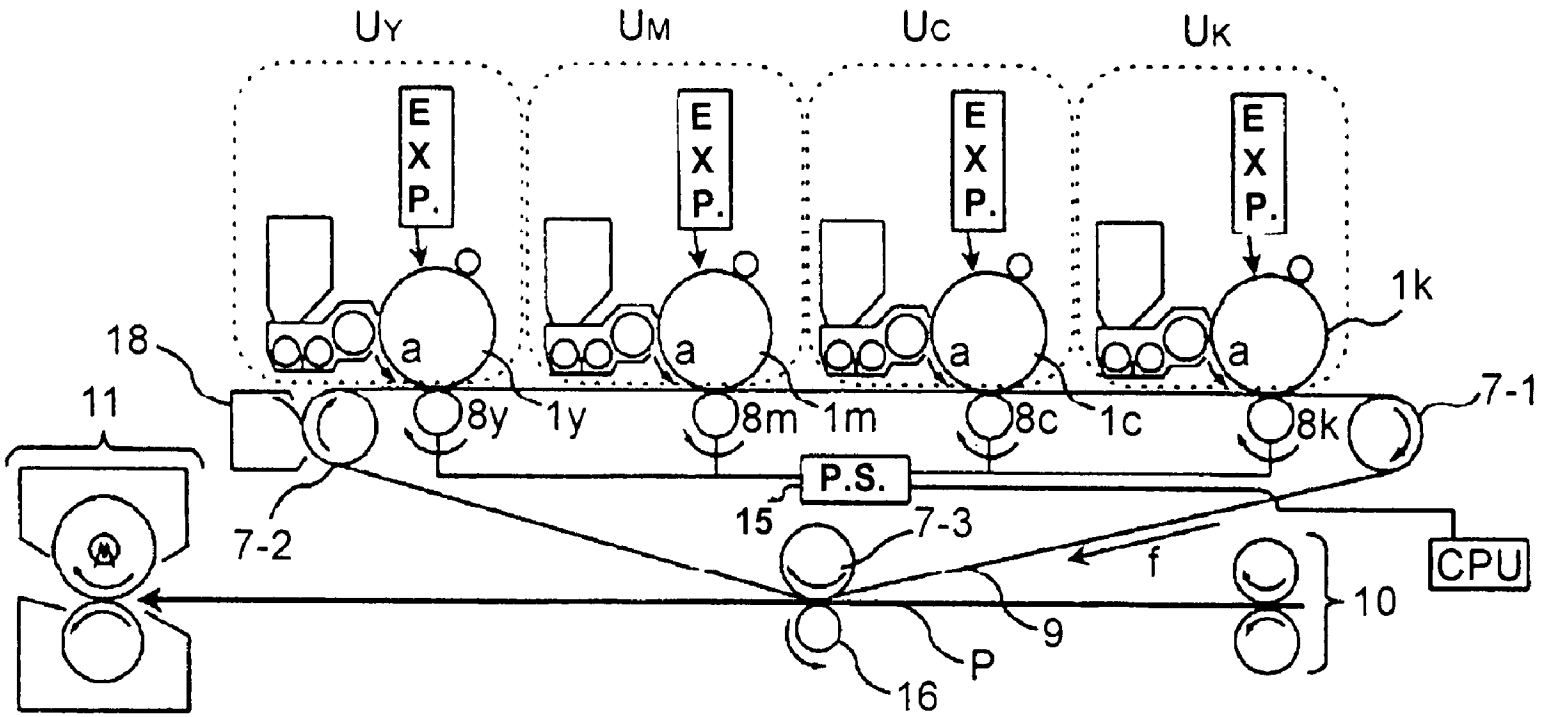
FIG. 5 is a schematic sectional view of the color image forming apparatus in the third embodiment of the present invention, which employs four photoconductive drums and an intermediary transferring member.

As a typical image forming apparatus to which this embodiment of the present invention is applicable, an image forming apparatus such as the one shown in FIG. 5 that comprises four drums and an intermediary transfer belt will be described. It should be noted here that this embodiment is also applicable to an image forming apparatus comprising a cylindrical intermediary transfer drum instead of an intermediary transfer belt.

The image forming apparatus in this embodiment is a full-color image forming apparatus having four image formation unit (IFUs) UY (yellow), UM (magenta), UC (cyan), and UK (black) image formation units, which are the same in structure and image formation process.

The process for forming an image on the photoconductive drum in each image formation unit is the same as the one in the above described embodiment. Therefore, the following description of this embodiment will be dedicated to the development process and the processes thereafter.

As a photoconductive drum 1y is rotated, a toner image, that is, visible image, formed on the photoconductive drum 1*y* (1*m*, 1*c*, and 1*k*) by the image formation unit UY (UM, UC, and UK) reaches the primary transfer station $Nt_{1-y}$ ($Nt_{1-m}$, $Nt_{1-c}$, and $Nt_{1-k}$) formed by this photoconductive drum 1*y* (1*m*, 1*c*, and 1*k*) and primary transferring apparatus 8*y* (8*m*, 8*c*, and 8*k*).

In the primary transfer station $Nt_{1-y}$, an intermediary transfer belt 9 as an intermediary transfer member is supported by a primary transferring apparatus 8*y* disposed in contact with the back side (inward side of belt loop) of the intermediary transfer belt 9, being pinched between a photoconductive drum 1*y* and the primary transferring apparatus 8*y*.

The primary transferring apparatus 8*y* is provided with a primary transfer bias power source 15 for applying bias opposite in polarity to toner.

The intermediary transfer belt 9 is an endless belt, and is stretched around a driving roller 7-1, a tension roller (follower roller) 7-2, and a secondary transfer station roller 7-3. It is rotated in the direction indicated by an arrow mark f.

As a toner image having just been formed on the photoconductive drum 1y reaches the primary transfer station $Nt_{1-y}$, the DC voltage in the range of +300–+500 V is started to be applied to the primary transferring apparatus By from the primary transfer bias power source 15. As a result, the toner image is transferred onto the intermediary transfer belt 9.

After being transferred onto the intermediary transfer belt 9, the toner image reaches and passes through the primary transfer stations $Nt_{1-m}$, $Nt_{1-c}$, and $Nt_{1-k}$ of the image formation unit UM, UC, and UK, respectively, one after another, due to the rotation of the intermediary transfer belt 9.

In synchronism with the arrival of the toner image at each of the transfer stations $Nt_{1-m}$, $Nt_{1-c}$, and $Nt_{1-k}$, an additional toner image is transferred in layers on the toner image (images) on the intermediary transfer belt 9. As a result, four toner images different in color are placed in layers on the intermediary transfer belt 9.

After being transferred in layers on the intermediary transfer belt 9, the four color toner images are further conveyed by the rotation of the intermediary transfer belt 9, reaching the secondary transfer station $Nt_2$. The second transfer station $Nt_2$ (which hereinafter will be referred to as secondary transfer station $Nt_2$) is made up of a secondary transferring apparatus 16 disposed on the outward side of the loop of the intermediary transfer belt 9, and the secondary transfer station roller 7-3 disposed on the inward side of the belt loop.

The intermediary transfer belt 9 remains pinched by the secondary transferring apparatus 16 and secondary transfer station roller 7-3, forming the second transfer nip, in the form of a narrow strip, between the secondary transferring apparatus 16 and intermediary transfer belt 9. For the secondary transfer operation, DC bias opposite in polarity to toner is applied to the secondary transferring apparatus 16 from an unshown secondary transfer bias power source. More specifically, the sheet P of recording paper, or the like, is delivered to the secondary transferring apparatus 16 from a registration roller 10 in synchronism with the arrival of the toner images thereat, and the toner images are transferred (secondary transfer) all at once onto the sheet P.

After the completion of the secondary transfer process, the sheet P is conveyed on an unshown separation-conveyance guide, reaching a fixing apparatus 11. In the fixing apparatus 11, the toner images on the sheet P are welded to the surface of the sheet P by heat and pressure. Then, the sheet P is discharged out of the image forming apparatus.

Meanwhile, the toner, etc., remaining on the intermediary transfer belt 9 after the completion of the secondary transfer process are removed by a cleaning blade 18 (which may be fur brush instead) as a means for cleaning an intermediary transferring member, so that the intermediary transfer belt 9 can be repeatedly used for image formation.

Figure 6:
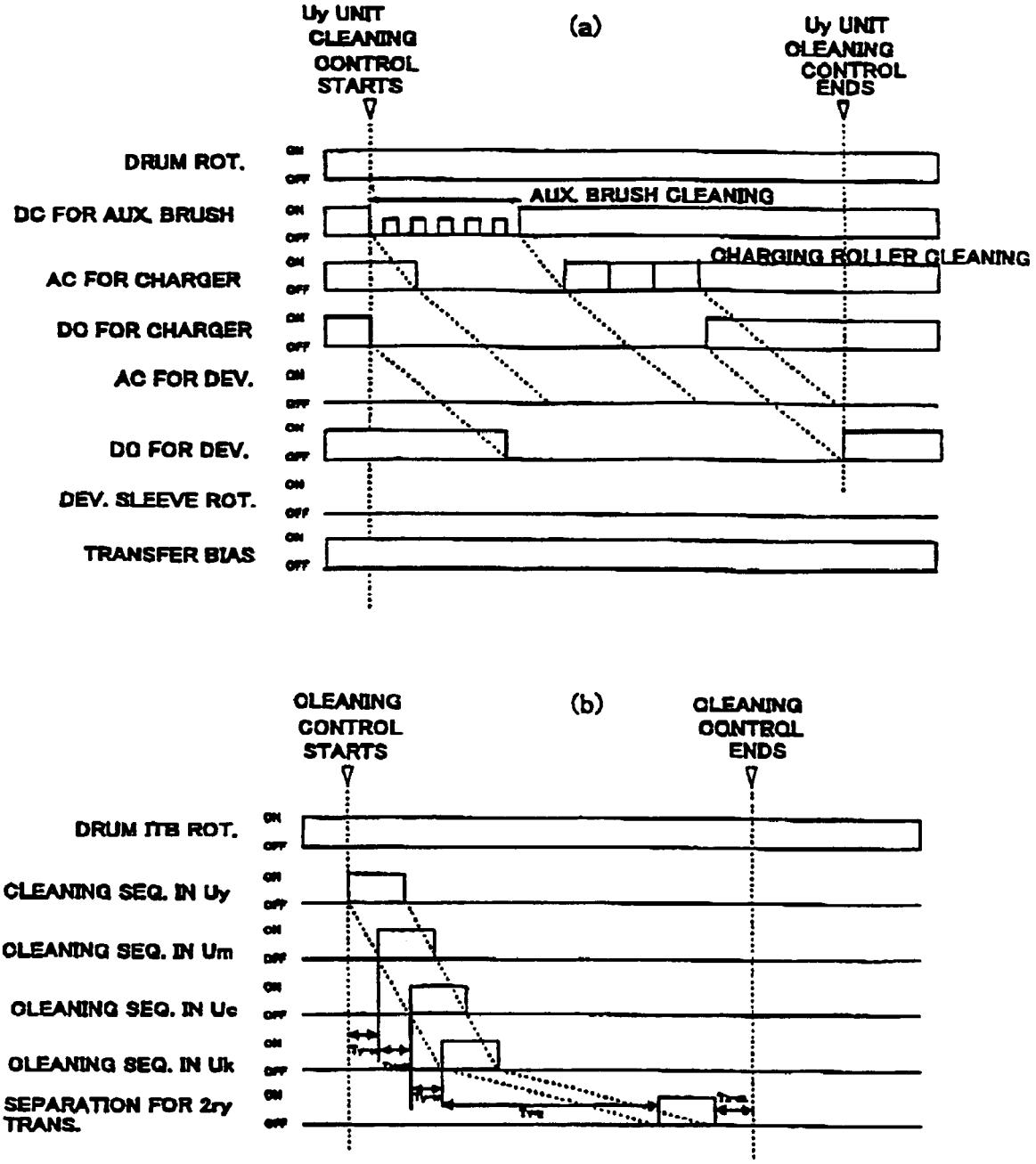
FIGS. 6(*a*) and 6(*b*) are timing charts of the cleaning sequence in the third embodiment.
Figure 7:
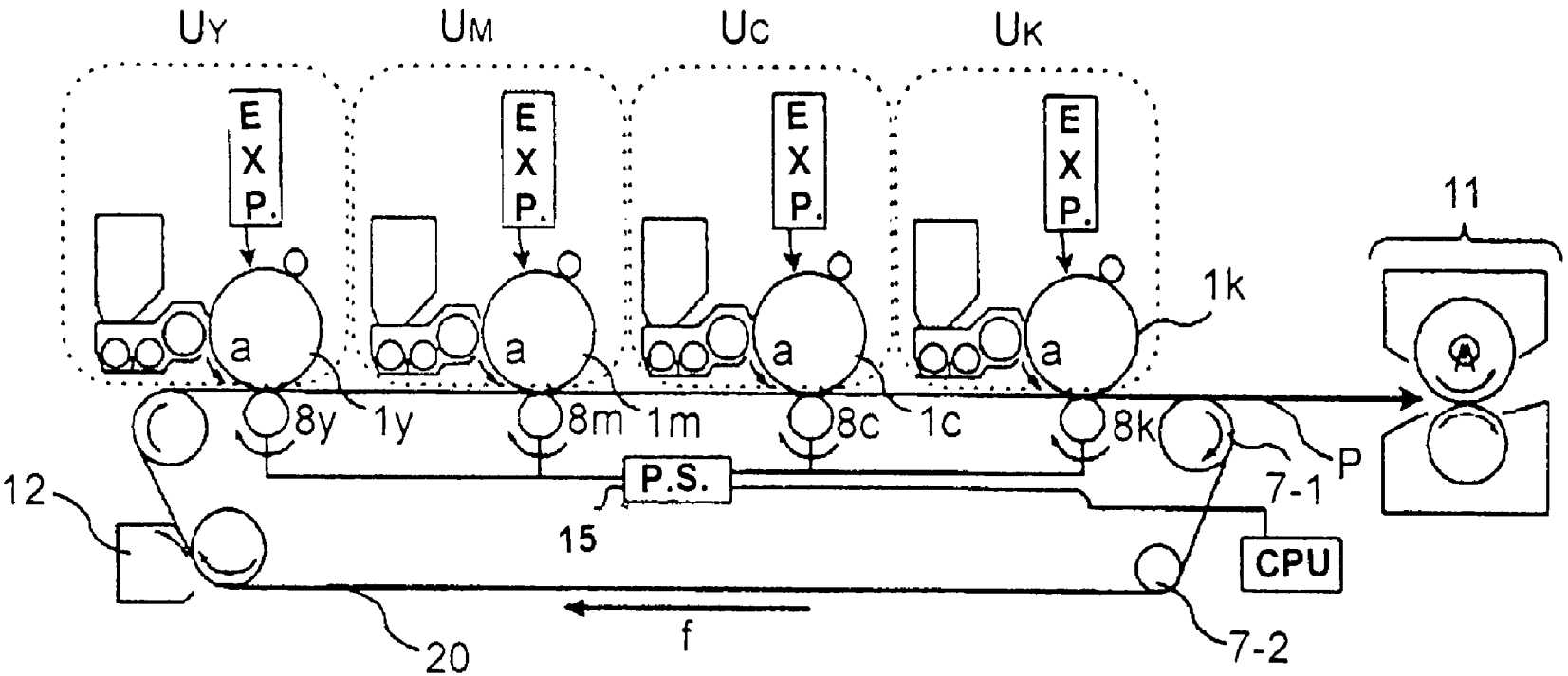
FIG. 7 is a schematic sectional view of the color image forming apparatus in the third embodiment of the present invention, which employs four photoconductive drums and an intermediary transferring belt.
Figure 8:
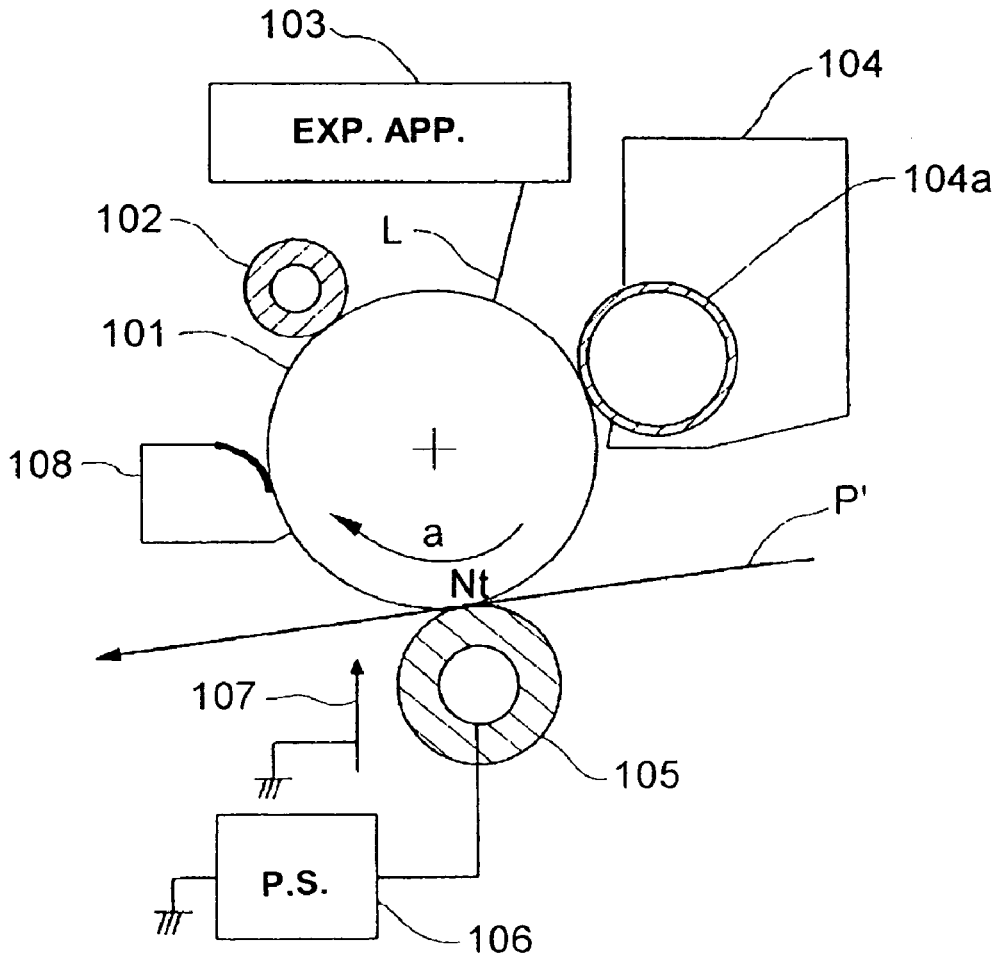
FIG. 8 is a schematic sectional view of an image forming apparatus comprising one of the conventional cleaning apparatuses, for showing the general structure thereof.
Figure 9:
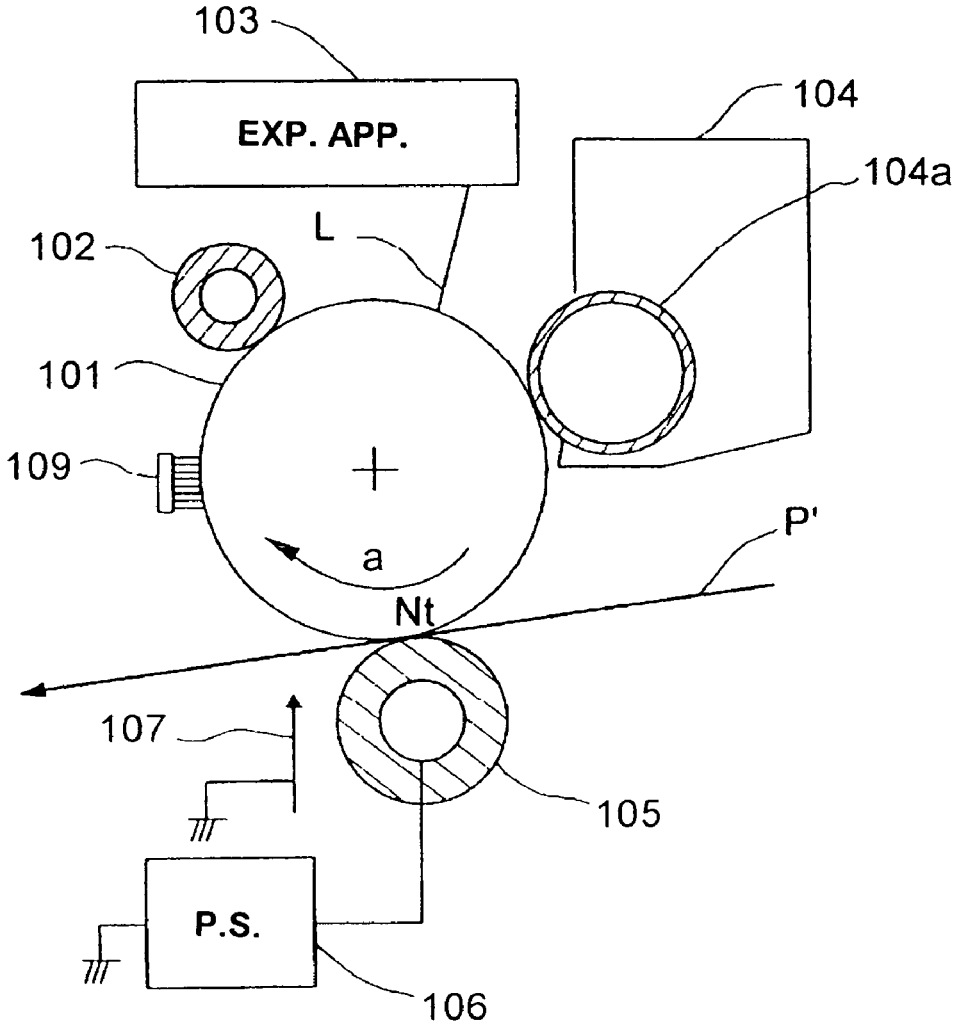
FIG. 9 PRIOR ART
FIG. 9 is a schematic sectional view of an image forming apparatus comprising one of the conventional cleaner-less systems, for showing the general structure thereof.

FIGS. 6(*a*) and 6(*b*) show timing charts for showing the timing with which the toner charging brushes and charge rollers in an image forming apparatus structured as described above are cleaned.

FIG. 6(*a*) shows the method for cleaning the toner charging brush and charge roller, and the timing with which the toner charging brush and charge roller of the image formation unit Uy are cleaned. Basically, this cleaning method and its timing are virtually the same as those in the first embodiment.

This cleaning method is different from that in the first embodiment in that during the cleaning of the toner charging brush and charge roller in the image formation unit Uy, the development bias, that is, the combination of the AC and DC biases are not applied, and the development roller is not rotated. This is for preventing the toner expelled from the toner charging brush 12 and charge roller from being recovered into the developing apparatuses, in order to prevent the toner in the image formation unit Uy from being contaminated by the toners from the other image formation units. Further, the primary transfer bias is kept on during the cleaning sequence, so that the expelled toner is transferred (primary transfer) onto the intermediary transfer belt 9.

FIG. 6(*b*) is the timing chart for the method for cleaning all of the toner charging brushes and charge rollers of the image forming apparatus in this embodiment.

First, the cleaning sequence is started in the first image formation unit Uy. Then, the cleaning sequence is started in the second image formation unit Um with a delay equal to the difference ($T_{y\text{-}m}$: different in image formation phase between yellow and magenta images) in image formation timing between the first and second image formation units Uy and Um. Thereafter, the cleaning sequence is sequentially started in the image formation units Uc and Uk, with the same amount of delay from the preceding unit.

The toner expelled from the toner charging brushes and charge rollers onto the photoconductive drums are transferred (primary transfer) onto the intermediary transfer belt, as are toner images during a normal image formation process.

Having transferred onto the intermediary transfer belt, the toner reaches the second transfer station $Nt_2$, $T_{1\text{-}2}$ length of time later, due to the rotation of the intermediary transfer bell ($T_{1\text{-}2}$: time required for a given point on intermediary transfer belt to move from primary transfer station of downstream most image formation unit, in terms of moving direction of intermediary transfer belt, to secondary transfer station). In synchronism with the arrival of the expelled toner, at the secondary transfer station, the secondary transferring apparatus is moved away from the intermediary transfer belt, preventing thereby the expelled toner from adhering to the secondary transferring apparatus. Thus, the expelled toner on the intermediary transfer belt passes intact through the secondary transfer station $Nt_2$, reaching the position of the intermediary transfer belt cleaner after a time of $T_{2\text{-}CL}$, where it is scraped away from the intermediary transfer belt by a cleaning blade, and is recovered into the waste toner container of the cleaner ($T_{2\text{-}CL}$: time required for a given point on intermediary transfer belt to move from secondary transfer station to intermediary transfer belt cleaner).

The reason for transferring the toner resulting from the cleaning of the toner charging brushes and charge rollers in all the image formation units, onto the same portion of the intermediary transfer belt is to prevent the reverse transfer of the expelled toner, as well as to reduce cleaning time.

As for the timing with which the cleaning sequence is to be initiated, it may be during the pre-rotation period of a photoconductive drum, that is, immediately after the main power is turned on, or during the post-rotation period of a photoconductive drum, that is, immediately after the completion of a printing job, as it is in the first embodiment. Further, if a given job requires the output of a substantial number of prints, the outputted prints, pic-cells, or exposure time, are to be counted, and it should be determined in accordance with the cumulative value of one of these factors when the cleaning sequence is to be initiated.

As will be evident from the above description, even in the case of the cleaner-less color image forming apparatus in this embodiment, which employs the four photoconductive drums and intermediary transferring member, the formation of a defective image, the defects of which are traceable to the improper charging of a photoconductive drum, can be prevented by cleaning the toner charging brushes and charge rollers thereof in the same manner as are the toner charging brush and charge roller cleaned in the first embodiment.

Needless to say, the same benefits as those obtained by the preceding embodiments can be obtained even in the case of an image forming apparatus, which is not provided with an intermediary transferring member, but, in which the toner images formed on the four drums are sequentially transferred onto the sheet P being conveyed by a conveyer belt 20 as a conveying means while being adhered thereto. In the case of this type of image forming apparatus, the toner resulting from the cleaning of the toner charging brush and charge roller and having transferred onto the photoconductive drum may be recovered by the developing device, or transferring means. Further, it may be transferred onto the conveyer belt so that it can be recovered by the conveyer belt cleaning means 12 as a means for cleaning the sheet conveying means. In the case of an image forming apparatus employing four drums and a conveyer belt, it is desired that the toners expelled from each image formation unit is transferred onto the same portion of the conveyer belt, because doing so makes it possible to prevent the reverse transfer of the expelled toner, as well as to reduce the cleaning time. Obviously, the present invention is also applicable to an image forming apparatus having a cylindrical intermediary transfer drum instead of an intermediary transfer belt.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

charging means for electrically charging said image bearing member while contacting to said image bearing member;

transferring means for transferring a developed image on said image bearing member onto a transfer material;

developer charging means for electrically charging a developer remaining on said image bearing member after the image is transferred, said developer charging means being disposed downstream of said transferring means and upstream of said charging means with respect to a moving direction of said image bearing member; and electric field forming means for forming a cleaning electric field in a direction of transferring the developer from said developer charging means onto a predetermined region of said image bearing member and for forming a cleaning electric field for transferring the developer from said charging means onto said image bearing member after the predetermined region of said image bearing member passes through a contact portion between said charging means and said image bearing member.

2. An apparatus according to claim 1, wherein when said cleaning electric field for said developer charging means is formed, said developer charging means is supplied with a voltage which is different from a voltage applied to said developer charging means during image formation, and wherein when said cleaning electric field for said charging means is formed, said charging means is supplied with a voltage different from a voltage applied to said charging means during image formation.

3. An apparatus according to claim 1, wherein when the predetermined region of said image bearing member is contacted by said charging means, a potential of said charging means is a ground potential.

4. An apparatus according to claim 1, wherein said charging means is in the form of a rotatable roller, and said cleaning electric field of said charging means is formed by application of an AC voltage to said charging means for not less than a time duration corresponding to one full turn of said charging means.

5. An apparatus according to claim 4, wherein a peak-to-peak voltage of said AC voltage is changed after said roller rotates through not less than one full turn.

6. An apparatus according to claim 1, wherein the cleaning electric field for said charging means is formed by application of an AC voltage without application of a DC voltage.

7. An apparatus according to claim 1, wherein the cleaning electric field for said charging means is formed by changing a peak-to-peak voltage applied to said charging means so as to be different from that during the image formation.

8. An apparatus according to claim 1, wherein said developer charging means includes a brush of electroconductive resin fibers contactable to said image bearing member.

9. An apparatus according to claim 1, wherein the cleaning electric field for said developer charging means is formed by application of a pulse voltage to said developer charging means.

10. An apparatus according to claim 9, wherein the pulse voltage is formed by switching a DC voltage.

11. An apparatus according to claim 1, wherein the cleaning electric fields for said developer charging means and said charging means are formed during a pre-rotation period of said image bearing member from actuation of a voltage source of said image forming apparatus to a stand-by state, or during a post-rotation period of said image bearing member from completion of an image forming process to stop of image forming apparatus.

12. An apparatus according to claim 1, wherein applications of the cleaning electric fields for said developer charging means and said charging means are carried out on the basis of a number of printed transfer materials.

13. An apparatus according to claim 1, wherein applications of the cleaning electric fields for said developer charging means and said charging means are carried out on the basis of formed pixel numbers.

14. An apparatus according to claim 1, further comprising exposure means for forming a latent image by exposure of said image bearing member charged by said charging means, and the cleaning electric fields for said developer charging means and said charging means are formed when an integrated exposure time of said exposure means reaches a predetermined level.

15. An apparatus according to claim 1, wherein the developer transferred onto the predetermined region of said image bearing member is collected by developing means for developing the image on said image bearing member.

16. An apparatus according to claim 1, wherein the developer transferred onto the predetermined region of said image bearing member is collected to said transferring means by an electric field.

17. An apparatus according to any one of claims 2–16, further comprising a plurality of image forming means each comprising said image bearing member, said charging means and said developer charging means, feeding means for feeding the transfer material to transfer portions of said image forming means, wherein the developer transferred onto the image bearing member of each image forming means is transferred onto the same position of said feeding means to which the transfer material is not feeding by the image forming means.

18. An apparatus according to claim 17, wherein the developer transferred onto the same position of said feeding means is collected in a feeding means cleaning operation for removing the developer from said feeding means.

19. An apparatus according to claim 17, wherein said feeding means includes a conveyer belt.

20. An apparatus according to claim 17, wherein said feeding means is in the form of a feeding drum.

21. An apparatus according to any one of claims 2–16, further comprising a plurality of image forming means each comprising said image bearing member, said charging means and said developer charging means, wherein said transferring means includes primary transferring means for primary transfer of the developed image from said image bearing member onto an intermediary transfer member, and a secondary transferring means for transferring the developed image transferred onto said intermediary transfer member onto the transfer material, and the developer transferred onto said image bearing member of each image forming means is transferred onto a same position of said intermediary transfer member by said image forming means.

22. An apparatus according to claim 21, wherein the developer transferred onto the same position of said intermediary transfer member is collected during intermediary transfer member cleaning operation for removing the developer from said intermediary transfer member.

23. An apparatus according to claim 21, wherein said intermediary transfer member is in the form of a transfer belt.

24. An apparatus according to claim 21, wherein said intermediary transfer member is in the form of a transfer drum.

* * * * *

UNITED STATES PATENT AND TRADEMARK OFFICE

CERTIFICATE OF CORRECTION

PATENT NO. : 6,987,939 B2
APPLICATION NO. : 10/676106
DATED : January 17, 2006
INVENTOR(S) : Tatsunori Ishiyama et al.

It is certified that error appears in the above-identified patent and that said Letters Patent is hereby corrected as shown below:

IN THE DRAWINGS:

In Figure 3, “OUNT” should read --COUNT--.

COLUMN 1:

Line 10, “relate” should read --relates--.

COLUMN 2:

Line 19, “an” should read --in--; and
Line 60, “in” (first occurrence) should read --is--.

COLUMN 3:

Line 25, “case” should read --case of--.

COLUMN 6:

Line 40, “an” should read --on--.

COLUMN 7:

Line 12, “t” should read --to--;
Line 35, “bing” should read --being--; and
Line 60, “recovered” should read --been recovered--.

UNITED STATES PATENT AND TRADEMARK OFFICE

CERTIFICATE OF CORRECTION

PATENT NO. : 6,987,939 B2
APPLICATION NO. : 10/676106
DATED : January 17, 2006
INVENTOR(S) : Tatsunori Ishiyama et al.

It is certified that error appears in the above-identified patent and that said Letters Patent is hereby corrected as shown below:

COLUMN 10:

Line 45, “is” should read --be--;
Line 53, “Job” should read --job--; and
Line 58, “detective” should read --defective--.

COLUMN 14:

Line 18, “By” should read --8y--; and
Line 36, “The” should read --¶ The--.

COLUMN 15:

Line 30, “different” should read --difference--.

COLUMN 16:

Line 37, “is” should read --be--; and
Line 55, “to” should be deleted.

COLUMN 18:

Line 6, “and” should read --and ¶--.

Signed and Sealed this

First Day of August, 2006

JON W. DUDAS
*Director of the United States Patent and Trademark Office*